US005271378A

United States Patent [19]

Herold

[11] Patent Number: 5,271,378

[45] Date of Patent: Dec. 21, 1993

[54] PLASTIC HEATING BOILER WITH INTEGRAL EXHAUST GAS CLEANING

[75] Inventor: Lothar Herold, Röllbach, Fed. Rep. of Germany

[73] Assignee: Herwi-Solar-GmbH Forschung und Entwicklung, Röllbach, Fed. Rep. of Germany

[21] Appl. No.: 768,532

[22] PCT Filed: Apr. 5, 1990

[86] PCT No.: PCT/EP90/00533

§ 371 Date: Oct. 3, 1991

§ 102(e) Date: Oct. 3, 1991

[87] PCT Pub. No.: WO90/12259

PCT Pub. Date: Oct. 18, 1990

[30] Foreign Application Priority Data

Apr. 5, 1989 [DE] Fed. Rep. of Germany ..... 3910994

[51] Int. Cl.[5] ..... F24H 1/20

[52] U.S. Cl. ..... 126/360 A; 122/31.2

[58] Field of Search ..... 122/31.2, 19, 13.1; 126/360 A

[56] References Cited

U.S. PATENT DOCUMENTS 4,685,444 8/1987 Durrenberger ..... 126/360 A
4,768,495 9/1988 Zifferer ..... 126/360 A
4,974,551 12/1990 Nelson ..... 122/13.1 X

FOREIGN PATENT DOCUMENTS 0623057 9/1978 U.S.S.R. ..... 126/360 A

*Primary Examiner*—Edward G. Favors
*Attorney, Agent, or Firm*—Quarles & Brady

[57] ABSTRACT

The invention relates to a heating boiler in which a combined absorption and heat conveyor fluid (22) is heated by the direct contact with the exhaust combustion gas (20) of a fuel. This fluid (22) at the same time cleans the exhaust gas, provides a heat shield between the combustion chamber (4) and the container (1) of the boiler and extracts the heat of condensation of the fuel. In such an arrangement of the boiler it is possible to make the container (1) of the heat conveyor fluid (22) economically of synthetic material while obtaining great efficiency and environmental acceptability.

10 Claims, 2 Drawing Sheets

PLASTIC HEATING BOILER WITH INTEGRAL EXHAUST GAS CLEANING

FIELD OF APPLICATION

Figure 1:
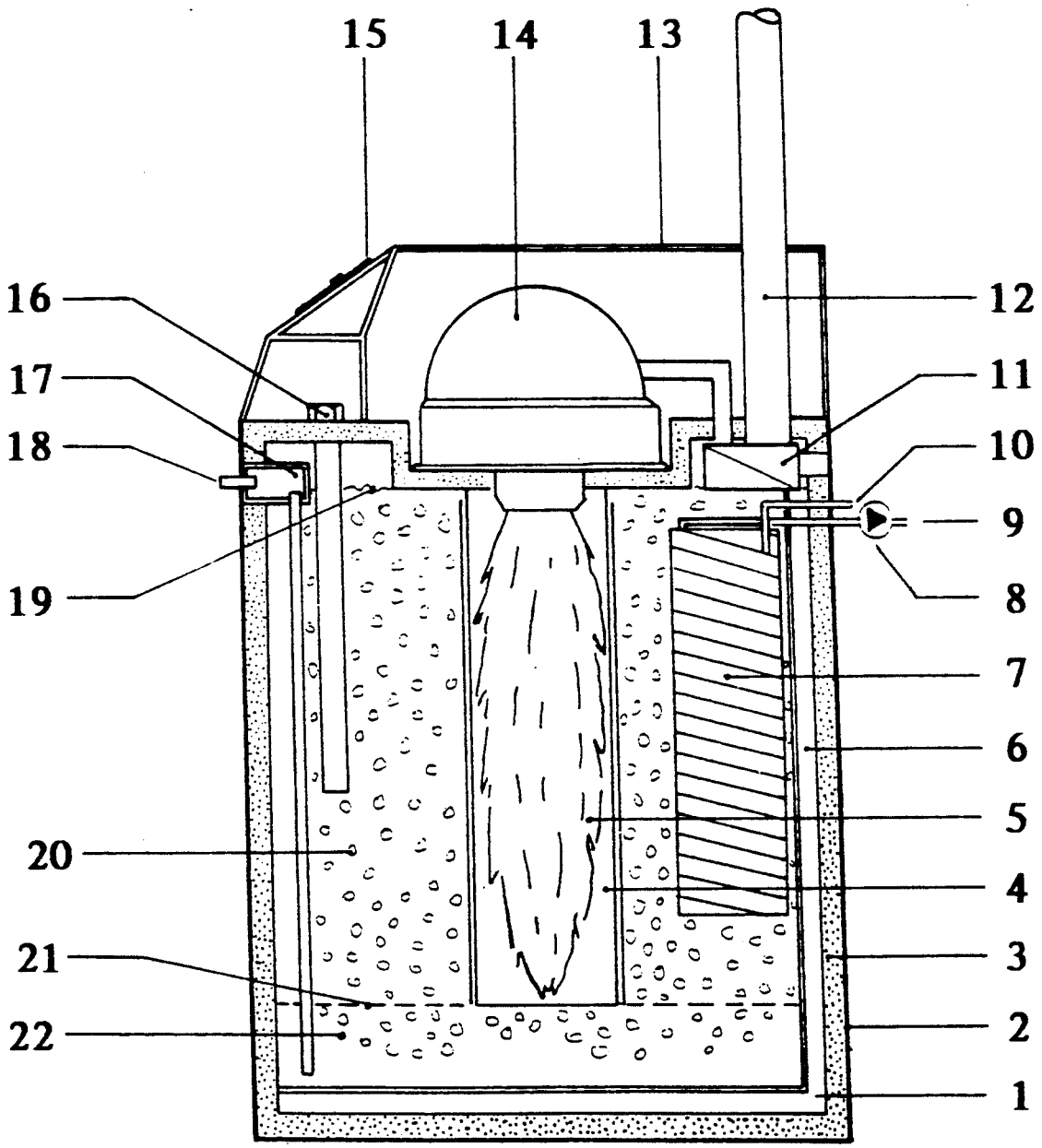

The invention relates to a heating boiler for liquid fuels, gaseous fuels and/or pulverulent fuels, in which the heating takes place via one or more built-in burners by direct contact of the exhaust combustion gases with a heat conveyor fluid in a container and the heat of condensation of the fuel is utilised.

Such a heating boiler is utilised in particular in domestic heaters of low or medium output, preferably with domestic water heating. However, its use can also be envisaged in industrial applications.

CHARACTERISTIC OF THE KNOWN STATE OF THE ART

Heating boilers for heating purposes normally heat a gaseous or liquid heat conveyor by burning liquid, solid or gaseous fuels in a combustion chamber consisting of highly heat resistant materials such as steel, cast or stone walls which can withstand the high combustion temperatures. The heat is transferred by contact of the heat conveyor with the walls of the combustion chamber, which are contacted by the exhaust combustion gases. The exhaust combustion gases at relatively high temperatures and containing harmful substances are then diverted via a substantially heat insulated flue pipe.

Increased efforts to achieve better operating efficiency and lower concentrations of harmful substances, have resulted in diverging solutions. Thus, heating devices are known in which the flue gases are passed through a heat conveyor fluid, thereby utilising the heat of condensation. Furthermore, solutions are known in which harmful substances are neutralised from condensation products, such products, such as disclosed for example in the DE-OS 34 06 028, or the concentration of harmful substances in the combustion gases is reduced.

The drawback with the commonly used heating boilers is the costly manufacture, the low degree of efficiency and the high concentration of harmful substances in the exhaust gases.

Since the very high temperatures are produced in the combustion chamber, costly and difficult to process materials are used in order to maintain the required temperature stability. Steel and cast iron materials, which are normally used, have to be made into combustion chambers and boiler housings by work processes which are costly in energy and time, resulting in high production costs.

Because the heat transfer takes place in the walls of the combustion chamber through convection of the combustion gases, the inadequate heat transfer results in a high exhaust gas temperature and is therefore inefficient. However, the high exhaust gas temperature has hitherto been deliberately maintained so as to prevent the exhaust gases from falling below the dew point and thus to prevent destruction of the heating boiler and the sooting up of the conventional flue gas pipes, or expensive materials were used which were unaffected by the condensation products.

The exhaust combustion gases reach the atmosphere without cleaning and then discharge into it especially sulphur oxide, carbon monixide, carbon dioxide, nitrogen oxide and soot.

The latest heating boilers even use the heat of condensation in order to increase efficiency, in which additional heat exchangers cool the exhaust gases below the dew point or in which the exhaust gases are brought into direct contact with the heat conveyor liquid. Neutralising the resulting condensation products, such as described for example in the DE-OS 34 06 028, is very cumbersome and thus leads to very high manufacturing costs or is not envisaged at all. However, since a large quantity of harmful, acid-containing condensate is produced by the condensation of the combustion gases, for environmental reasons the operation of such a heating boiler without neutralising or cleaning the condensate is not possible.

From the FR-A-2 547 648 is known a heating boiler with condensation installed after the boiler. The exhaust combustion gases are passed through a water curtain formed between an upper and a lower container. The water curtain is part of a water circulation force fed by a pump via the two containers. The combustion chamber is situated in the upper container and the combustion gases produced therein are fed via pipes to the outside of the upper container where they pass through the water curtain. However, the delivery of heat and harmful substances through the thin water curtain is inadequate, since the residence time of the exhaust combustion gases in the water curtain is very short. Moreover, neutralisation of the harmful substances is not provided. Although polyester is used in the manufacture of the two containers, the construction as a whole is extremely problematic as the hot pipes from the exhaust chamber have to be passed through the wall of the container.

AIM OF THE INVENTION

The aim of the invention therefore is to produce a heating boiler which can be operated in an environmentally friendly manner, which is highly efficient and which is cost-effective to manufacture.

DISCLOSURE OF THE ESSENTIAL FEATURE OF THE INVENTION

Starting from the above drawbacks of the known technical solutions, it is the object of the invention to produce a heating boiler which, whilst utilising the heat of condensation, substantially reduces the harmful substances in the exhaust combustion gases, neutralises as well as absorbs these harmful substances and furthermore permits the cost-effective manufacture of the same, is easy to assemble, has a low weight and, because the danger of corrosion is removed, a long life.

According to the invention a heating boiler of the type described at the beginning is characterised in that the container for the heat conveyor fluid is made of plastics and the wall of the combustion chamber is made from a material which is resistant to the acid formation in the heat conveyor fluid and to the temperatures that occur, that a device is provided in the heat conveyor fluid for distributing the exhaust combustion gases discharging beneath the combustion chamber, and that the heat conveyor fluid has added to it an agent for neutralising the harmful substances removed from the exhaust combustion gases.

In the heating boiler according to the invention, the open at the bottom combustion chamber is built into the plastics container of the absorption and heat conveyor fluid in such a way that during operation it is outwardly completely surrounded by this fluid, whilst in the inoperative condition of the heating boiler it is flooded by the heat conveyor fluid. It was found that the above measures allowed an inexpensive and easy to process material, i.e. plastics, to be used for almost all the parts of the heating boiler, including the container. This use of plastics brings with it a considerable technical advantage, especially since plastics parts do not corrode.

The exhaust combustion gases conducted during operation of the heating boiler through the heat conveyor fluid are distributed in the form of small bubbles and as they rise up they give off their heat and the harmful substances almost completely. These harmful substances are collected by the heat conveyor fluid and chemically neutralised in the corrosion-proof plastics container, after which the waste can be removed without endangering the environment.

Analyses in recent years have shown that particularly conventional heating boilers used domestically cause environmental damage on a global scale. This damage can be substantially reduced by a heating boiler which is energy-saving and free of harmful substances. Since the essentially plastics heating boiler offers a smooth operation, the main field of application therefore is in the area of domestic heating.

The use of plastics containers was hitherto excluded in the construction of heating boilers since the high flame temperature and the low melting point of the plastics were regarded as incompatible. As a result of the invention, the thermal screening through the heat conveyor fluid and the corrosion resistance of the plastics make it possible for the first time to economically realise the said advantages.

Wider scope for the environmentally friendly heating boiler according to the invention is achieved as a result of the low manufacturing costs and the lasting value of using plastics materials together with the simple installation and servicing required.

EMBODIMENT EXAMPLE

Figure 2:
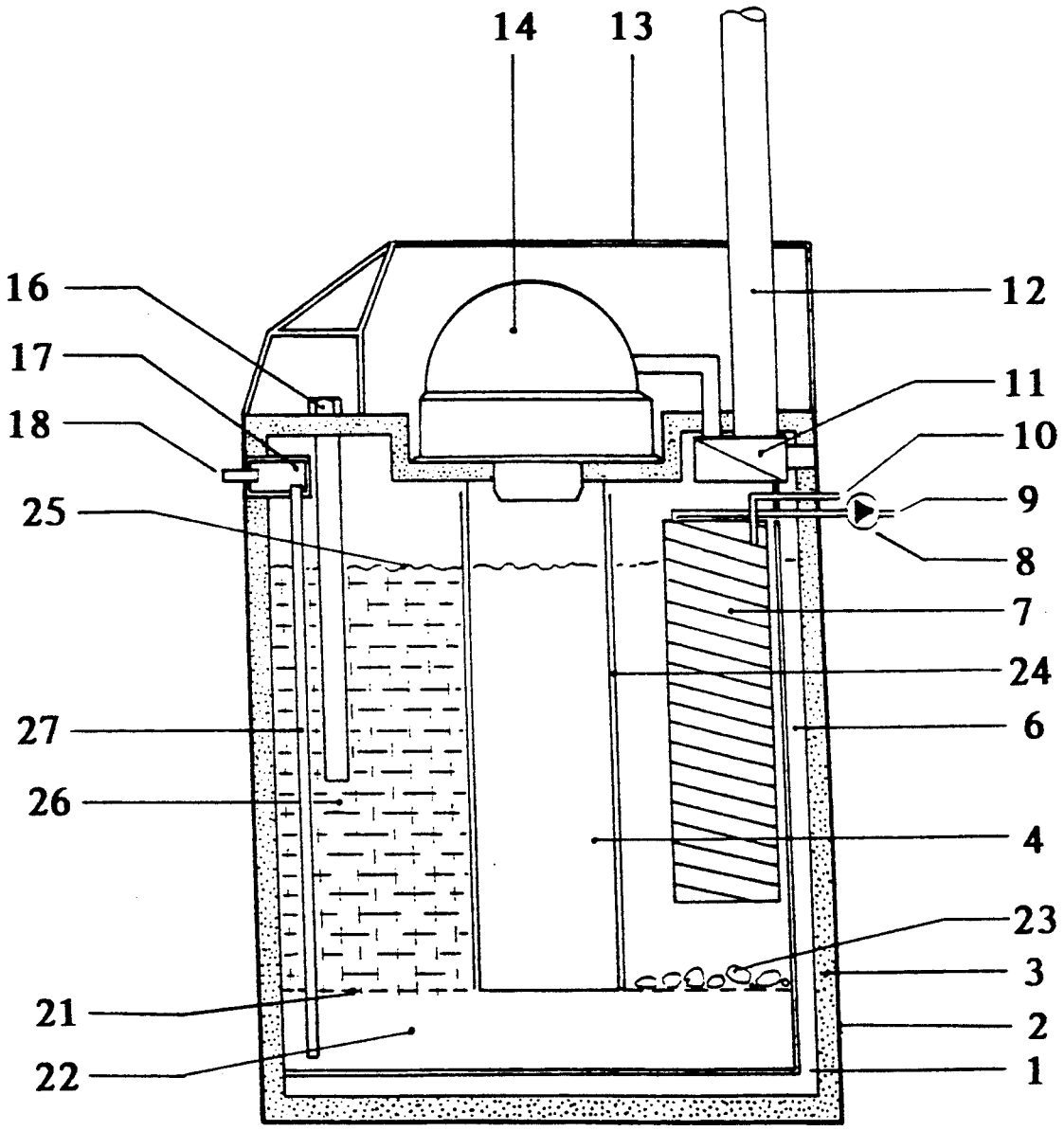

A preferred embodiment example of the invention is described in detail with the aid of the following drawings. However, the invention is not limited to this embodiment example. There is shown:

FIG. 1 a principle representation, partly in section, of the embodiment example of the invention during the heating operation, FIG. 2 a similar representation to FIG. 1, but during a break in operation and with alternative and/or additional features.

The realised construction of the heating boiler shown as the embodiment example can readily be seen by the expert in FIGS. 1 and 2. In here the legends mean: 1 container, 2 outer wall of the container, 3 insulation of the container, 4 combustion chamber, 5 combustion flame, 6 double casing heat exchanger, 7 heating circuit heat exchanger, 8 heating circuit circulating pump, 9 heating circuit forward flow, 10 heating circuit return flow, 11 cross current heat exchanger, 12 exhaust gas pipe, 13 burner cladding, 14 burner (preferably gas or oil), 15 operating display panel, 16 absorption and neutralising agent cartridge, 17 filter cartridge, 18 condensation discharge, 19 surface of an absorption and heat conveyor fluid during operation, 20 combustion exhaust bubbles, 21 exhaust gas distributer screen, 22 absorption and heat conveyor fluid, 23 granulate-like absorption and neutralising agent, 24 combustion chamber wall, 25 surface of the absorption and heat conveyor fluid during the break in operation, 26 filler and 27 riser pipe.

When the heating boiler is in the operating state, the interior of the pressure-free container 1 contains a heat conveyor fluid 22, preferably water. The combustion chamber 4, which is surrounded by the fluid 22, can be built into the centre of the upper part of the container 1. The combustion taking place here heats the heat conveyor fluid 22, as described later. Since water at normal pressure cannot reach more than 100° C. and since in heating installations temperatures higher than approximately 90° C. are not generally required, it is possible to construct of plastics the container 1 which is in contact with the heat conveyor fluid 22 and which must be resistant to heat and melting at temperatures of 90° to 100° C. Plastics are easily worked, are cheaper than conventional materials for making heating boilers and have numerous other advantageous properties. Cross-linked polyethylene is preferably used. The expert is familiar with the manufacturing of plastics parts of various shapes and the application of conventional manufacturing processes presents no problems.

Thus, for example, it is possible with known manufacturing methods to construct the heat insulation 3 of the container 1 on the inside of the outer casing 2. This preferably takes place by foaming the heat insulation 3 at a desirable thickness on the inside, so that the ready-made outer casing 2 can be constructed during the same work process as the insulation 3. Any additional degreasing, preparation, insulation and painting or use of coating materials is therefore unnecessary. In contrast to the plastics container 1 comprising of the integrated outer wall 2 and the insulation 3 according to the invention, in the state of the art the heat insulation is normally separately applied to the outside of a steel or cast iron container.

Furthermore, plastics offer a high degree of resistance against chemically aggressive fluids which are produced when temperatures fall below the dew point or when the heat of condensation is used in a certain way.

As described above, the combustion chamber 4 is situated in the upper internal region of the container 1. It is preferably applied vertically with the burner 14 on the upper side of the container 1 in such a way that the burner 14 is accessible from outside. The combustion chamber 4 is open at the bottom, so that in the inoperative or ready condition it is largely filled by the heat conveyor fluid 22 without, however, wetting the burner 14 or its ignition device. The construction clearly shows that the combustion air supplied by the fan of the burner 14 can escape only at the bottom of the combustion chamber 4, i.e. through the heat conveyor fluid 22.

The burner 14 may be a conventional, known type of burner, but preferably with a more powerful fan. An expert can readily carry out this modification.

Prior to using the burner 14, the combustion chamber 4 is emptied. This is achieved by blowing in air through the burner fan or by creating a vacuum through the fluid 22 externally of the combustion chamber 4, or by using a combination of these techniques. In all cases, a pressure difference is created which displaces the heat conveyor fluid 22 from the combustion chamber 4, so that beneath the combustion chamber 4 the air supplied through the burner 14 can escape or bubble to the top.

Through emptying the combustion chamber 4, the heat conveyor fluid 22 previously contained therein has risen in the container 1 and now covers preferably the entire outer part of the combustion chamber 4, as can be seen in the comparative representation between FIGS. 1 and 2. As fuel and combustion air is supplied, the flame 5 burns inside the emptied combustion chamber 4. The combustion gases 20 thus produced escape towards the bottom through the open part of the combustion chamber 4 and bubble to the surface of the heat conveyor fluid 22.

The combustion chamber wall 24 is made from a material which is resistant to the temperatures occurring inside and to the formation of acid in the heat conveyor fluid 22, such as for example metal, ceramic, glass or even plastics. Since the fluid 22 which has risen along the wall 24 effects a constant cooling of the entire combustion chamber 4, in the case of larger combustion chamber diameters without direct flame contact it is also possible to use a material which can withstand only low temperatures. By means of suitable constructional measures the strengthening of the combustion chamber 4 is so designed that the plastics material of the container 1 is not stressed beyond its maximum temperature resistance. In any case, the combustion chamber 4 can be kept within small dimensions, so that even when for example stainless steel is used, the costs are kept to a minimum.

The exhaust combustion gases 20 given off during the combustion process below the combustion chamber 4 are distributed by a device which results in the smallest possible gas bubbles 20. In the simplest case this is a fine-mesh screen or sieve 21 through which are passed the exhaust gases. For improving the effects, this screen or sieve 21 can be excited to generate mechanical oscillations causing a strong swirling effect in the fine gas bubbles 20.

The slowly upwardly swirling bubbles 20 now form a turbulent foaming bath in which are located the heat exchangers 6, 7 for the heating and domestic water supply circuits. These heat exchangers 6, 7 are designed as pipes, ribbed pipes, plates or other types of heat exchanger. Such designs are known to the experts. Materials used are stainless steel, copper or other corrosion-resistant materials. However, according to the invention the heat exchangers 6, 7 are made from plastics. Because of the turbulent movement of the heat conveyor fluid 22 the heat transfer is substantially better than in static fluids or fluids in which there is only slight movement. Plastics has the advantage of being free from corrosion, being easy to shape and being cheap to manufacture. The heat exchanger 7 can be so designed that the exhaust gas bubbles 20 can come into intimate contact with the exchanger surfaces, thereby achieving improved efficiency. A preferred possibility is the construction of a double casing heat exchanger 6 in the container 1. This is preferably used for heating domestic water.

As shown in FIG. 2, the container 1 can additionally be provided with a filler 26 which prevents the movement of the gas bubbles 20 and thus effects a prolonged delay time in the fluid 22 and at the same time enlarges the reaction surface. Consequently the heat delivery and the delivery of harmful substances is improved, as now described.

As they bubble up the exhaust gas bubbles 20 not only give off heat to the heat conveyor fluid 22, but also their harmful substances. This takes place through chemical reactions. For this reason chemicals are added to the heat conveyor fluid 22, for example calcium carbonate, which combines with the sulphur of the exhaust combustion gases 20 to form calcium sulphate. This causes a neutralising and retention of the sulphur which would otherwise pass into the atmosphere. The neutralising product, which after all represents gypsum, is removed in a thickened form at specific servicing intervals and in accordance with current regulations can be disposed of without problems in the domestic waste disposal.

When using other neutralising substances, such as for example magnesium hydroxide, apart from sulphur, other environmentally harmful substances such as carbon dioxide and nitrogen oxides are chemically fixed. However, hardly any nitrogen oxides are produced during burning in the cooled combustion chamber 4, so that their removal from the exhaust combustion gases 20 under certain circumstances can be omitted altogether. Because they are environmentally friendly, the neutralising products of some chemicals with the excess condensation fluid which forms in the heat conveyor 22 can even be discharged into the sewers via the condensation outlet 18. As can be seen from the drawings, the condensation outlet 18 is connected to the riser pipe 27.

The required chemicals can be added to the fluid 22 in liquid form, or in the form of a granulate-like absorption and neutralizing agent 23, as shown in FIG. 2. However, in order to achieve a simpler servicing and better control it makes sense to bring the neutralising chemicals used, e.g. as pressed or sintered cartridge 16, into contact with the fluid 22 through an opening in the container 1. The use of the chemicals can then be determined by optical control or automatically, and a servicing message can then be left through a control system on the operating and display panel 15. Such a monitoring system can be readily effected by someone skilled in the art on the strength of his expert knowledge.

Even if through legal rulings in future the residual products are classed as special waste, there still remains the big advantage, which should not be underestimated, that no environmental pollution can take place by discharging harmful substances into the atmosphere, but that a controlled removal of the residual products can take place.

The residual products, amongst others, are soot, dust and other particles, as well as unburnt constituent parts of oil (in oil fired systems). These too are separated out in the heat conveyor fluid 22. Its removal too can be effected at larger servicing intervals, e.g. yearly. A filter cartridge 17 is preferably built into the container 1 between the riser pipe 27 and the condensate outlet 18. The filter cartridge 17 serves to separate these particles or solid substances, so that these can be removed by changing the cartridge. By introducing the excess condensate through the filter cartridge 17, it is thus impossible for solid waste products to get into the sewers.

The combustion gases which collect in the container 1 above the heat conveyor fluid 22, are substantially cleaned and are now passed through the exhaust gas pipe 12 into the atmosphere either direct or via a heat exchanger 11. The container 1 is of course sealed on all sides so that the entire exhaust gas is forced into the exhaust gas pipe 12. The exhaust gas heat exchanger 11 is preferably designed as a conventional air-air-cross current heat exchanger and transfers the residual heat of the exhaust gases 20 to the sucked-in additional combustion air. The temperature of the exhaust gases in the exhaust gas pipe 12 is therefore only slightly higher than that of the surroundings. This makes it possible for example to use a plastics pipe also for the exhaust gas pipe 12.

Since further cooling of the exhaust gases on cold parts of the exhaust gas pipe 12 could result in slight condensation, provision should be made for the condensate to be fed back to the container 1. In conventional heating systems the formation of condensate in connection with the harmful substances contained therein, would result in a sooting up of the conventional chimneys. However, because of the low temperature difference in the heating boiler described here there is hardly any condensate and because of the almost zero content of harmful substances, a sooting up of the chimneys can hardly be expected.

Alternatively, the heat exchanger 11 may be arranged in the air-water-heat exchanger which heats the domestic or swimming pool water. The heat exchanger 11 can also be used for heating the return flow 10 of the heating circuit.

All the building materials and parts necessary for manufacturing the heating boiler, including the chemicals, are available in the trade. The fillers 26 are conventional fillers of metal and/or plastics, such as used in chemical processes. The burner cladding 13, in which is integrated the operating and display panel 15, can also be constructed of plastics.

The burner 14 is of course connected to a fuel feed pipe (not shown). At suitable points in the plastics container 1 there are provided gas and fluid-tight sealable openings (not shown) through which the heating boiler can be serviced and the waste removed. The container can be sealed in a gas and fluid-tight manner through conventional screw connections.

Finally, there are described a number of manufacturing methods for producing the plastics parts of the heating boiler, especially the container and the heat exchanger:

1. Rotational sintering:

A plastics powder is introduced into a hollow mould, corresponding to the container 1, which rotates about two axles, making a tumbling movement. The mould is heated in an oven to approximately 250° C., causing the plastics powder to melt. The wall thickness of the outer wall 2 of the container 1 formed in this way is thus determined by the quantity of the powder. In a second heating process, by adding further plastics powder and propellant, the inner insulation 3 is foamed up. The thickness of the insulation 3 is determined by the quantity of the plastics powder and the propellant.

In a second work stage is manufactured a second smaller container (heat exchanger wall of the double casing heat exchanger 6) which is then introduced into the first container 1. A seal between inner and outer container can be achieved through melting or gluing. Should a removable lid be required for the container 1, this can be manufactured in one of these work stages.

2. Injection moulding process
3. Blow moulding method
4. Deep drawing method
5. PU-Integral foam method
6. Synthetic fibre laminates The processes mentioned in 2 to 6 represent further possibilities of making containers, insulation, double casing and other heat exchangers. These methods are known per se.

The materials used are the PE (polyethylenes) commonly available in the trade such as those supplied by firms such as e.g. Neste, General Electric Plastic, Hoechst and many others, or fibre-reinforced plastics such as e.g. FRP, which is marketed and supplied by many manufacturers.

In the deep drawing method are used foamed plate material such as for example FOREX ot KOMACEC (by Kommerling) in order to manufacture outer casing and insulation in one work process. PU (polyurethane) is supplied for example by the firm Bayer and BASF. From this also can be manufactured outer casing and insulation.

Other plastics which are sufficiently heat stable and chemically stable can also be processed by the said methods.

I claim:

1. A heating boiler for liquid fuels, gaseous fuels and/or pulverulent fuels, in which the heating takes place via one or more built-in burners by direct contact of the exhaust combustion gases with a heat conveyor fluid in a container and the heat of condensation of the fuel is utilized, wherein the container for the heat conveyor fluid is made of plastic and a wall of the combustion chamber is made from a material which is resistant to acid formation in the heat conveyor fluid and to temperatures that occur, and that a device is provided in the heat conveyor fluid for distributing the exhaust combustion gases discharging beneath the combustion chamber, and that the heat conveyor fluid comprises an agent for neutralizing the harmful substances removed from the exhaust combustion gases.

2. A heating boiler according to claim 1, wherein in the container there is situated at least one heat exchanger made of plastic.

3. A heating boiler according to claim 1, wherein a double casing of the container forms a heat exchanger.

4. A heating boiler according to claim 1, wherein an exhaust gas pipe connected to the container is made of plastic.

5. A heating boiler according to claim 1, wherein said device for distributing the exhaust combustion gases includes a fine-mesh screen.

6. A heating boiler according to claim 1, wherein a filler is provided in the container.

7. A heating boiler according to claim 1, wherein cartridge means is provided for adding a neutralizing agent including an absorption and neutralizing chemical.

8. A heating boiler according to claim 1, wherein a filter cartridge means in the container separates solid harmful or dirty substances from the heat conveyor fluid.

9. A heating boiler according to claim 1, wherein a thermal insulation is situated on the inside of the outer wall of the container.

10. A heating boiler according to claim 1, further including a heat exchanger means which utilizes the residual heat of the exhaust gas stream.

* * * * *